United States Patent [19]

Richards

[11] 4,071,244

[45] Jan. 31, 1978

[54] SUSPENSION GAME

[76] Inventor: Marvin David Richards, 1109 E. Date, Brea, Calif. 92621

[21] Appl. No.: 789,572

[22] Filed: Apr. 21, 1977

[51] Int. Cl.[2] ..... A63F 3/00

[52] U.S. Cl. ..... 273/275; 46/28; 273/288; 273/1 R

[58] Field of Search ..... 273/1 R, 1 E, 1 M, 135 F, 273/130 R, 130 A, 130 AB, 130 AC; 46/28

[56] References Cited

U.S. PATENT DOCUMENTS

| | | | |
|---|---|---|---|
| 3,092,384 | 6/1963 | Herne | 273/1 R |
| 3,102,609 | 9/1963 | Gerard | 46/28 UX |
| 3,241,833 | 3/1966 | Luchsinger | 273/1 R |
| 3,392,480 | 7/1968 | Stubbmann | 46/28 X |
| 3,452,989 | 7/1969 | Vernstron | 273/135 F |
| 3,537,706 | 11/1970 | Heavener | 273/1 R |

*Primary Examiner*—Paul E. Shapiro
*Attorney, Agent, or Firm*—J. C. Baisch

[57] ABSTRACT

A construction game that employs two separate game boards, each depicting the games' goals and providing the main support for the assemblying of the two completely independent structures. The completed structure will be a bridge abstraction, or more specifically a suspension system that is capable of being extended the length of the game board while maintaining a particular height requirement. The suspension system is achieved by a plurality of building elements that, except for duplication, are infinitely varied and diverse in their configurations and methods by which they connect one to another. The first building element connects to the game board's starting edge; and each subsequent element is connected with the former element until the construction is high enough and long enough to reach the winning line at the opposite end of the game board.

The players use game money in a competitive bidding process to obtain each building element.

14 Claims, 7 Drawing Figures

SUSPENSION GAME

BACKGROUND OF THE INVENTION

1. Field of the Invention

This invention relates generally to games and relates more particularly to a construction game which utilizes building elements with a multiplicity of shapes and connecting ends. Their attachment to each other is one of an artful application due to the irregular openings and loose fittings. The goal of the game is to construct a bridge-like or suspension system the length of the game board before one's opponent constructs a like structure the length of his game board.

2. Description of the Prior Art

As is well known in the art, various types of building toys have been designed and used. Generally, these toys provide various building blocks whereby one can construct buildings and other structures of different designs. To my knowledge, none has been incorporated in a manner to also include a competitive game during the actual building of a structure, as is herein disclosed.

As far as I am aware, there is nothing in the prior art of the character of the present invention.

SUMMARY OF THE INVENTION

The present invention comprises the use of a plurality of building elements, which can also be referred to as structural blocks, wherein these blocks are to be sequentially suspended over a game board. That is, there is provided two game boards having printed thereon various game goals that are accomplished during the building of a bridge-like support structure which defines the game suspension system. The suspension system is achieved by connecting in an end-to-end relationship each particularly selected building element. Some of these elements have duplicate configurations but, in general, are provided with infinitely varied and diverse configurations and methods by which they can be connected to each other. Each building element includes a main body, wherein a varied combination of connecting ends are provided. That is, some elements will include one female connecting end and one male end; others have both ends either female or male, with the addition of a starter block adapted to be attached to one end of the game board, which is also referred to as the base element. There is also included a ballast block element which is employed primarily when a player's suspension begins to sag, this block acting as a weight factor with one end thereof weighted.

Thus, by complying with a set of game rules, one player tries to build a bridge-like suspension with the various blocks so that they will extend across the length of the game board at a preferred selected height. Positioned on each game board is a height gauge having markings thereon to indicate various game requirements during play as the system is constructed in length and height.

Several methods of play can be employed; and a detailed description of one example will be hereinafter included.

OBJECTS AND ADVANTAGES OF THE INVENTION

The present invention has for an important object a provision for combining the use of structural building blocks to form a bridge-like suspension together with a competitive game including other elements such as a pair of game boards and play money which provide a novel building game heretofore not known in the art.

It is another object of the invention to provide a building-block suspension game that includes building elements that are interconnected to each other in a very loose manner thereby adding individual skill, as well as luck, in completing the game.

It is still another object of the invention to provide a game of this type having a plurality of structural block elements wherein each element is varied in its individual design to aid in the construction of a bridge-like suspension system, so as to control the height and length thereof to a finish line provided on the game board.

It is a further object of the invention to provide a bridge-like suspension game having two systems being built simultaneously, wherein the first player to complete his system and maintain the proper height thereof is the winner.

It is still a further object of the invention to provide a building game of this type wherein the manipulation of the play money has a significant part in the operation and success of the game, whereby the first player who reaches the end of his playing board at the proper height is awarded the game or other gestures, depending upon the particular rules being used.

The characteristics and advantages of the invention are further sufficiently referred to in connection with the accompanying drawings, which represent one embodiment. After considering this example, skilled persons will understand that variations may be made without departing from the principles disclosed; and I contemplate the employment of any structures, arrangements or modes of operation that are properly within the scope of the appended claims.

DESCRIPTION OF THE DRAWINGS

Referring more particularly to the accompanying drawings, which are for illustrative purposes only.

DESCRIPTION OF THE PREFERRED EMBODIMENT

Figure 1:
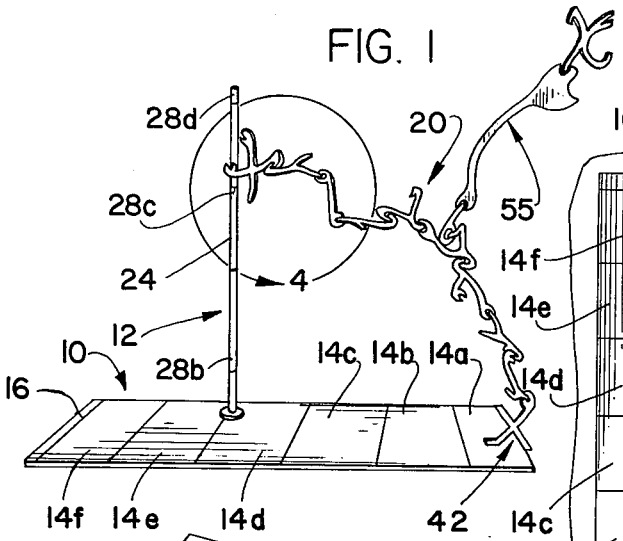
FIG. 1 is a pictorial view of the game apparatus showing a suspension system constructed in a typical manner—starting at one end of the game board and projecting upwardly across the board.

Referring more particularly to FIG. 1, there is shown a game board, generally indicated 10, having positioned thereon a height-indicating means, which will hereinafter be referred to as the height meter 12. The game board 10 is divided into several pay zones indicated at 14*a*, 14*b*, 14*c*, 14*d*, 14*e*, and 14*f*, terminating with a winner line 16. As will later be described, each zone will indicate various amounts of monies that are paid to the player under certain game rules. That is, 14*a* might read $10,000; 14*b*, $40,000; 14*c*, $90,000; and so on—wherein zone 14*f* will read the highest amount, thus being the furthest from the starting zone 14*a*. It also should be mentioned that the height meter 12 is also divided into a plurality of sections so as to indicate the height of the suspension system, generally indicated at 20.

Accordingly, height meter 12 comprises a mounting base 22 in which a vertical rod or stick 24 is supported, said rod being marked by height lines 25 and 26 defining three zones 28*a*, 28*b* and 28*c*.

However, it should be noted that any number of zones both on the game boards or height meter can vary, depending on the rules of the game. One example of how the game can be played will hereinafter be described.

Figure 2:
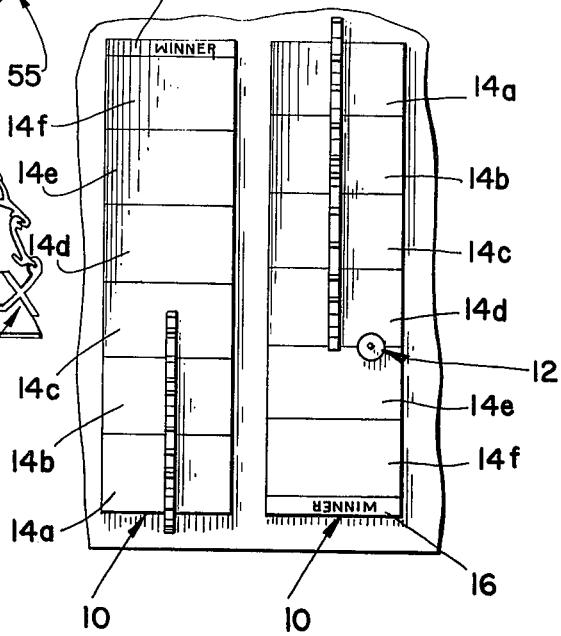
FIG. 2 is a top plan view of game boards arranged in a side-by-side relationship as would normally be done during game play.

The suspension game is provided with two separate game boards 10 having identical marking, and are to be arranged in a side-by-side longitutinal relationship whereby the bridge-like suspension system can be continuously compared during the progress of the game. This is well illustrated in FIG. 2.

Figure 5:
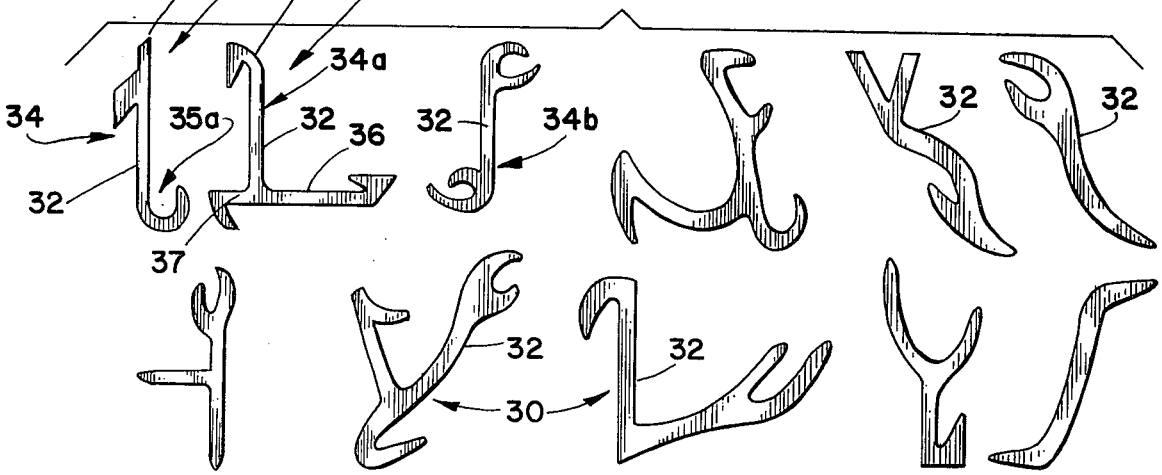
FIG. 5 is a plan view of various designed building elements having female and male connecting means.

Thus, the present invention comprises the use of a plurality of building-block elements, generally indicated at 30, the number of configurations of which is endless. However, each block comprises a main body section 32 wherein the free ends thereof can be defined as either a male or a female connection means. It can be seen in FIG. 5 in various block arrangements. Block 34 comprises main body 32 having one end defined as a male connecting end 35, and an opposite end formed as a female connecting end 35*a*. Block element 34*a*, however, is shown having a main body 32 and a pair laterally extending leg members 36 and 37, respectively. The free end of said body 32 is provided with a male end 35; and each end of each leg member is also arranged having male connecting ends 35. Element block 34*b* comprises a still different combination, that being a main body 32 having two free ends formed as female connecting means. Hence, the additionally illustrated block elements in FIG. 5 show several combinations of leg-extending members having various male and female connecting ends.

Figures 4, 7:
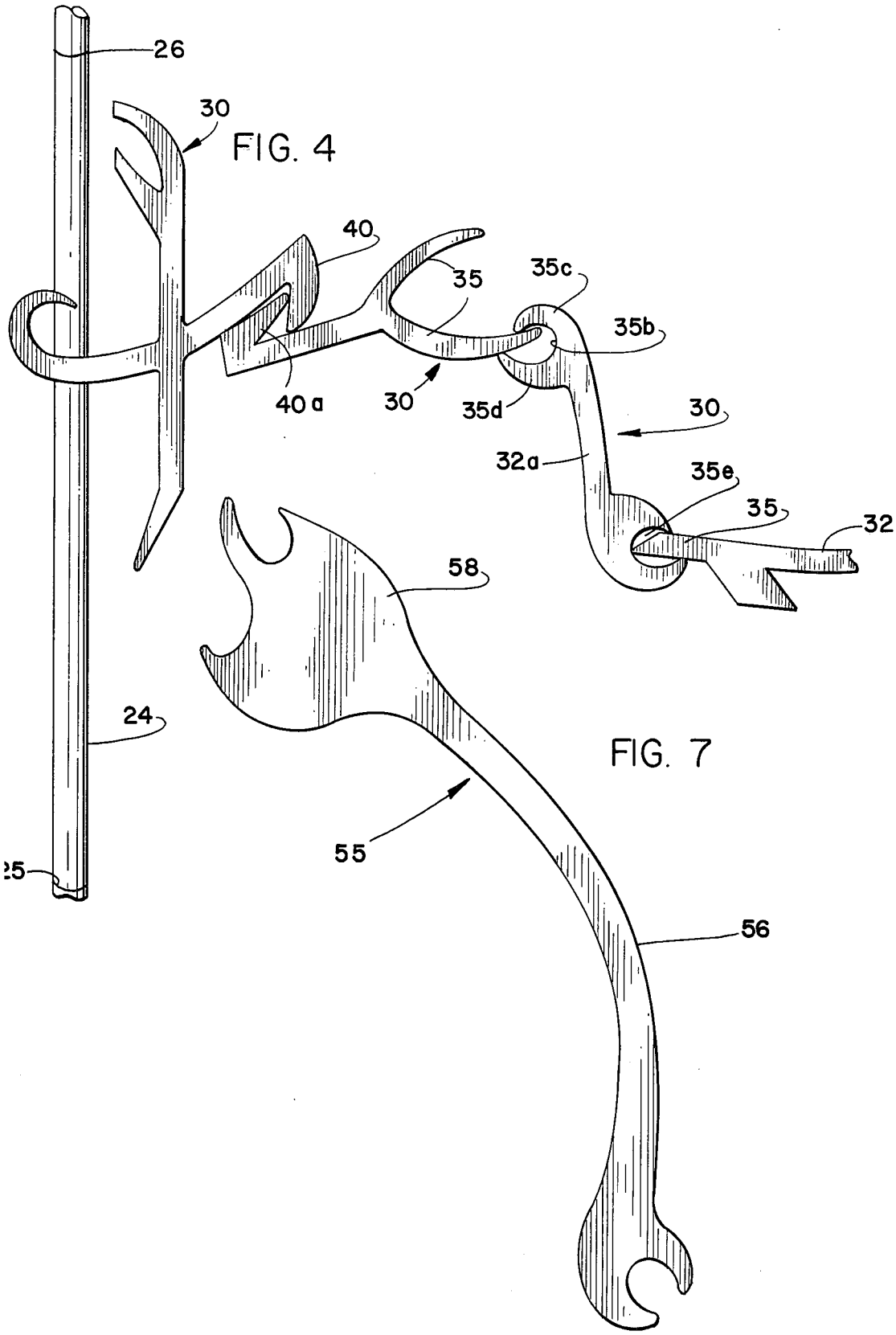
FIG. 4 is an enlarged view of a portion of the height-control stick and various designed building elements adjacent thereto.
FIG. 7 is an enlarged plan view of the element referred to as a ballast block.

The female connecting ends are generally provided with a somewhat "C"-shaped configuration, whereby the male end can be loosely engaged therein as seen in FIG. 4. Each block is arranged so as to bind with its adjacent block in such a manner as to provide a bridge-like suspension. As an example, note in FIG. 4, block 32*a*, that the upper female connection 35*b* has received male end 35 which is held in place by binding between arms 35*c* and 35*d*. The lower female connection 35*e* has male end 35 received therein and is held in place by the forward weight of the continuous blocks.

It should be further noted that several male ends such as 40 and 40*a* are so designed that it is possible to arrange them to bind as well. The employment of any connecting arrangement is determined by each player.

The block elements as previously described are the basic members used to create a bridge-like suspension system from one end of the game board to the other.

However, two other block elements are included within this game, one being a building-block base member and the other being a ballast member.

Figure 3:
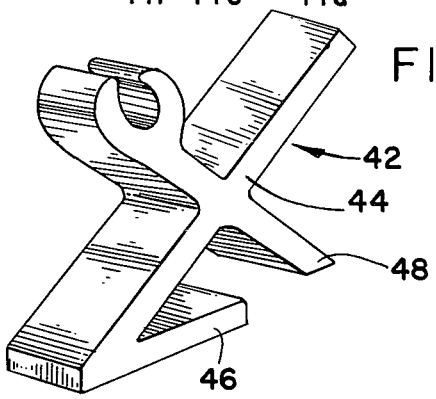
FIG. 3 is a perspective view of the base building element that is normally used to start the game by attaching it to the game board.

In order to provide a firm foundation for the suspension system, the game is normally started with a block-base member, generally indicated at 42 as seen in FIGS. 1 and 3. Said base block has a configuration which comprises a main body 44, the lower end forming a footing 46 that is positioned under the starting end of game board 10. Extending angularly downward from main body 44 is a leg member 48 which is arranged to engage the surface of the game board and act as a brace member to carry the entire weight of the suspension system as it is being constructed.

Included thereon is one upwardly extending female connection and an upwardly extending male connecting means, whereby the player may use either connection.

Figure 6:
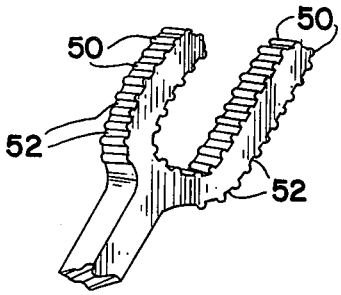
FIG. 6 is a perspective view of an alternative arrangement of a connecting end of a building element.

Referring to FIG. 6, there is shown an alternative connecting end comprising a plurality of tongues and grooves 50 and 52, respectively. Thus, it can be seen that, by adding said tongues and grooves to both the male and female connecting ends, a more stable interlocking arrangement can be provided.

Referring to FIG. 7, there is illustrated a ballast block, generally indicated at 55, having a curvilinear main body 56 that is provided at its lower end with a female connecting end, and at its upper end with an enlarged weighted end 58. This ballast block is used primarily when a player's suspension system begins to sag. The block is attached with weighted end 58 towards the starting area. This will then lift the system.

The following is one example of how the game can be played, since many variations can be adapted for use in conjunction with the elements of the present invention.

In playing the game, the players will choose up two sides. Each side may be composed of one or more players functioning as one. Each side will have one separate game board 10 on which they will construct one suspension system 20 the length of the board.

One player is selected to manage the banking in addition to working on his structure. Each side of players or player will be handed out $100,000.00, or any other suitable amount, in assorted play currency. All monies used in obtaining the building elements will be paid to the bank, including the acquisition of a player's building block elements. All zone bonuses, mortgages, and surplus payments are paid out from the bank.

The game boards are arranged to provide both sides with a clear view of the others' progress and to analyze possible advantages a player will obtain from a particular building block element.

The building elements are colored-coded in several different price categories. Their versatility and aid to construction establishes the price. For example, red, white, and blue are $4,000.00, orange and green are $7,000.00, and yellow and brown are $10,000.00 in price. These prices reflect the minimum bid for the respective element. The one ballast element 55 has a minmum price of $25,000.00, and may only be used suspended backwards for additional lift support of the suspension system.

The game begins with a toss of a coin or any other suitable means; and the winner then selects a building block element of his choosing. Both sides are allowed two minutes to determine if the selected element will benefit their particular structural needs. Both sides will then lie down their money with face value up. The holder of the highest amount will receive the element, and pay to the bank the money he bid. Should neither team bid enough for an element's minimum value, that element is returned. Irregardless of the bidding outcome, the turn to choose the next element will automatically alternate between sides.

The height meter 12 governs the construction of the suspension system. As it progresses down the game board, the structure will come to zones 14a–14f of increasing amounts that the bank will pay, or charge the players, if according to the height meter their structure is below the accepted level as indicated on the meter. If the structure is high enough, it may qualify for payment from the bank of one, two, or three times the amount shown on the particular zone line.

Surplus block is any block that has been purchased and the player cannot immediately connect it to his structure. Its minimum value becomes $2,000.00, irregardless of what the owner paid for it. He then places the element next to his construction; and during the next selection, that surplus element may either be selected by the opponent, causing the players to rebid for that element, or it is the player with the surplus whose turn it is to choose another element for bidding.

After his selection, the opponent may add the surplus element or bidding plus the minimum $2,000.00 for the surplus element. Now there are two elements with a minimum value of $2,000.00 for the surplus, plus whatever the value is of the new element.

The game board has five zone lines which, when crossed at the minimum height, will return to the players one times the dollar amount on that zone line. Should the player's structure cross a zone line above the 28c or 28d zone marks on the height meter, the bank will pay the player the respective amount. All crossings are measured by height meter 12 based upon the structures highest point straight over the game board zone line. The finish line pays $1,000,000.00, provided the player is first and his structure is of minimum height. The player may use as many hands as there are on his team, if construction necessitates additional support while putting on another element or wedging the system to go higher. If one or more elements fall, the player must pay the bank $2,000.00 for each element plus a $5,000.00 fine for down time. The game stands still for 6 minutes while that player reconstructs his suspension system. Any element not reused may be chosen, one at a time, as surplus.

Accordingly, the first player to complete his system above the finish line wins.

The invention and its attendant advantages will be understood from the foregoing description and it will be apparent that various changes may be made in the form, construction and arrangement of the parts of the invention without departing from the spirit and scope thereof or sacrificing its material advantages, the arrangement hereinbefore described being merely by way of example, and I do not wish to be restricted to the specific form shown or uses mentioned, except as defined in the accompanying claims.

I claim:

1. A suspension game comprising:

at least one game board having playing zones indicated thereon;

a plurality of building block elements arranged to be interconnected to each other and to said board to form a bridge-like suspension structure;

interconnecting means formed on the ends of said building-block elements;

a ballast block arranged to be connected to any one of said building-block elements to provide structural support to said suspension structure; and a height-metering means to be located on said game board to indicate height of said suspension structure during game play.

2. A suspension game as recited in claim 1, wherein said building-block elements include a block base including means to secure said block base to said game board.

3. A suspension game as recited in claim 2, wherein said building-block elements comprise:

a main body having at least two free ends on which said interconnecting means are formed, and wherein each block element includes individual design configurations.

4. A suspension game as recited in claim 3, wherein a plurality of said block elements include a main body having laterally extending leg members, said leg members having free ends formed with said interconnecting means thereon.

5. A suspension game as recited in claim 4, wherein said game includes two game boards positioned in a side-to-side relationship during game play, whereby two separate suspension structures are created during game play.

6. A suspension game as recited in claim 4, wherein said interconnecting means comprises:

a male connecting end; and a female connecting end.

7. A suspension game as recited in claim 6, wherein a plurality of block elements include all male connecting ends.

8. A suspension game as recited in claim 7, wherein a plurality of block elements include all female connecting ends.

9. A suspension game as recited in claim 8, wherein a plurality of block elements include a combination of male and female connecting ends.

10. A suspension game as recited in claim 9, wherein said ballast block comprises:

an elongated curvilinear main body having oppositely disposed free ends;

a connecting means formed at one free end thereof; and a weighted member formed at the opposite free end thereof.

11. A suspension game as recited in claim 10, wherein said height-metering means comprises:

a rod having metering zones marked thereon to indicate the height of said suspension structure during game play; and a support means arranged to position said rod in a vertical manner adjacent said suspension structure.

12. A suspension game as recited in claim 10, wherein said female connecting end comprises a substantially "C"-shaped configuration wherein said male end is held in a binding arrangement therein.

13. A suspension game as recited in claim 12, wherein said male and female connecting ends include a plurality of tongues and grooves, whereby said connecting ends are provided with positive locking connections.

14. A suspension game as recited in claim 12, wherein said securing means of said block base comprises:

a foot member formed at one end of said main body thereof; and an angularly extending leg member arranged adjacent to said foot member, wherein said foot member is formed to be positioned under said game board, and said leg member is arranged to engage the surface of said game board.

* * * * *